United States Patent [19]

Hooker

[11] 4,001,964

[45] Jan. 11, 1977

[54] POLYHEDRAL ANNULAR STRUCTURES, AND BLANKS THEREFOR

[76] Inventor: Rea Ferdinand Hooker, 170 W. 74th St., New York, N.Y. 10023

[22] Filed: July 7, 1975

[21] Appl. No.: 593,552

Related U.S. Application Data

[63] Continuation-in-part of Ser. No. 355,037, April 27, 1973, Pat. No. 3,894,352.

[52] U.S. Cl. ..... 46/1 L; 52/86; 93/84 R; 428/9

[51] Int. Cl.² ..... A63H 33/16

[58] Field of Search ..... 46/1 L, 21; 52/86, 81; 93/84 R, 84 FF, 84 TW; 428/9

[56] References Cited

UNITED STATES PATENTS

| | | | |
|---|---|---|---|
| 2,164,966 | 7/1939 | Tutein | 93/84 R |
| 3,302,321 | 2/1967 | Walker | 46/1 L |
| 3,346,998 | 10/1967 | Nelson | 46/21 |

FOREIGN PATENTS OR APPLICATIONS

| | | | |
|---|---|---|---|
| 653,204 | 11/1962 | Canada | 52/86 |

*Primary Examiner*—F. Barry Shay
*Attorney, Agent, or Firm*—Abner Sheffer

[57] ABSTRACT

Folded structures which are polyhedrons of generally toroidal shape, movable to various different stable configurations, made up of a series of hinged trapezoids.

12 Claims, 8 Drawing Figures

POLYHEDRAL ANNULAR STRUCTURES, AND BLANKS THEREFOR

This application is a continuation-in-part of my application Ser. No. 355,037 filed Apr. 27, 1973, U.S. Pat. No. 3,894,352 of July 15, 1975 (hereinafter termed "my parent patent"), whose entire disclosure is incorporated herein by reference.

This invention relates to a polyhedral structure which is radially substantially symmetrical about a central axis, said structure comprising a number of planar polygons hinged together at their sides so as to form a continous multiplanar toroidal web having two edges, which structure can be rotated, about its core, into various different stable configurations each of which is radially substantially symmetrical about said central axis.

Walker U.S. Pat. No. 3,302,321 describes a folded structure which is a polyhedron of generally hexagonal appearance composed of three rows of "interior" isosceles right triangles and two rows of "edge" isosceles triangles. The folded structure can be rotated to make five different stable configurations.

My parent patent describes folded structures which can be rotated to make six, seven or more different stable configurations, as well as folded structures which can be rotated to make a plurality of different stable configurations of differing heights made with non-isosceles triangles.

The present application describes structures made with polygons other than triangles, especially trapezoids.

Several forms of the invention are illustrated in the accompanying drawings which are drawn substantially to scale and in which FIG. 1 is a plan view, with repetitive portions broken away, of a blank for constructing a polyhedron having four rings of contiguously hinged trapezoids and two rings of triangles.

FIG. 2 shows what may be called position I (a "solid" position, in which the interior is completely hidden) and FIG. 3 shows position VII.

It will be seen that the illustrated blanks, and polyhedrons made therefrom, are constructed in generally the same manner as described for the blanks and polyhedrons of my parent patent. However, instead of the common apices (such as $C_2$ in FIG. 1 of my parent patent) there are common sides, such as those designated as S in FIG. 1, these being the shorter sides of each of the trapezoids. And instead of the "vertical" fold lines being infold lines all along their length (as with lines 11 of my parent patent) the folding direction alternates along the length of those vertical lines. Thus the portions of those vertical lines which are constituted by the common short sides S (or S′ or S″ ) are outfold lines while the portions corresponding to the longer sides (such as those designated as L or L′ or L″) are infold lines. Accordingly these figures may be viewed as modifications of those made from triangles, except that the triangles have been truncated with outfold lines (of truncation) replacing the apical points. These outfold lines provide additional stable positions (they provide additional pairs of substantially axially-located points). Thus a configuration having four rows of large triangles forms six stable positions (as described in my parent patent) while a configuration having four rows 2, 3, 4, 5, of trapezoids (as in FIGS. 1–4) forms 10 stable positions, i.e. one additional stable position per row of large trapezoids.

Figure 1:
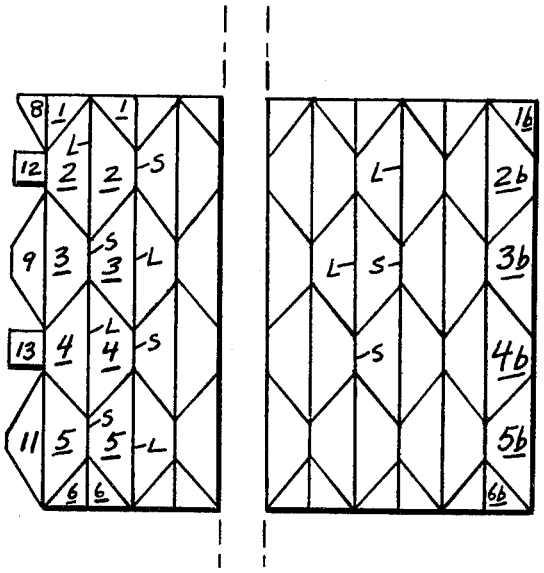
Figure 2:
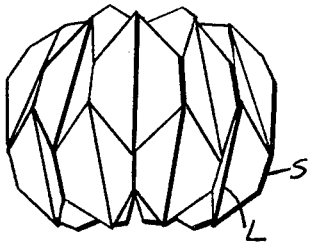
FIGS. 2 and 3 are side views illustrating two of the 10 different stable positions the assembled polyhedron (made from the blank in FIG. 1) will assume through a "rotating" or traversing action.
Figure 3:
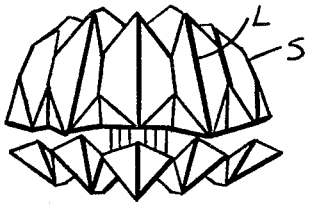
Figure 4:
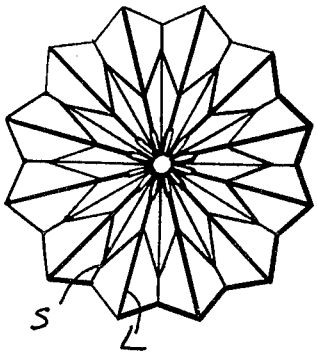
FIG. 4 is a top view of the polyhedron in that position VII.

As in the structures shown in my parent patent there may be rows of edge triangles such as edge triangles 1 and 6 of FIG. 1, and the blanks have ends which are adapted to be joined together, most conveniently by attaching tabs, such as tabs 8, 9 and 11 (attaching to end edge triangle 1*b* end trapezoid 3*b* and end traqezoid 5*b* respectively). Additional tabs may also be used, such as tabs 12 and 13 (attaching to the end trapezoids 2*b* and 4*b* respectively).

It will be understood, from the teachings of my parent U.S. Pat. No. 3,894,352 (whose entire disclosure is, as previously mentioned, incorporated herein by reference), that the blank is converted into the polyhedron by first folding the blank along the fold lines (in one direction along infold lines and in the opposite direction along outfold lines) see column 3, lines 7 to 24 of my parent patent), thus forming a flexible tube-like structure similar to that shown in FIGS. 2 and 2A of my parent patent (except of course that it has trapezoids instead of the large triangles of the patent), and that the resulting flexible folded structure is shaped into circular form and is kept in that form by attaching the tabs at one end thereof to the appropriate polygons indicated above (i.e. tab 9 to end trapezoid 3*b*, etc.) as by adhering the tab to the back of the appropriate polygon as mentioned at column 3 lines 1 to 6 and 44 to 45 of that patent.

The meaning of the term "stable positions" is explained in my parent patent, as in the portion at column 4 lines 40 to 64; that portion, as well as the portion beginning at column 3 line 63 to column 4 line 39, also describes the rotating process. As described in my parent patent, the structure can be rotated by pushing it inward at the top and pulling it outward at the bottom. During the process of rotating from one stable position to another the structure passes, of course, through a whole series of intermediate positions. If the rotating forces are removed then the structure is in an intermediate position it tends to return to the preceding stable position or to move, by itself, to the next stable position.

Figure 5:
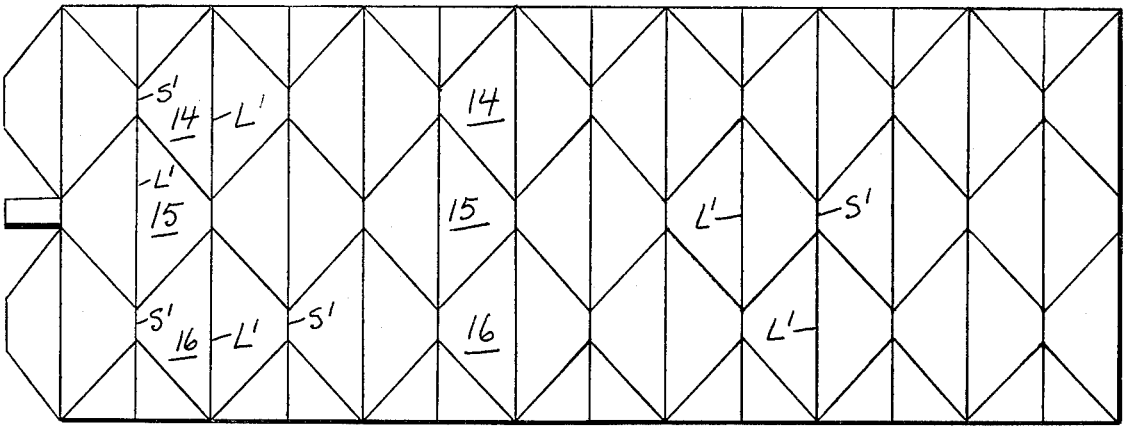
FIG. 5 is a plan view of a blank for constructing a polyhydron having 3 rings of trapezoids, and two rings of triangles.
Figure 6:
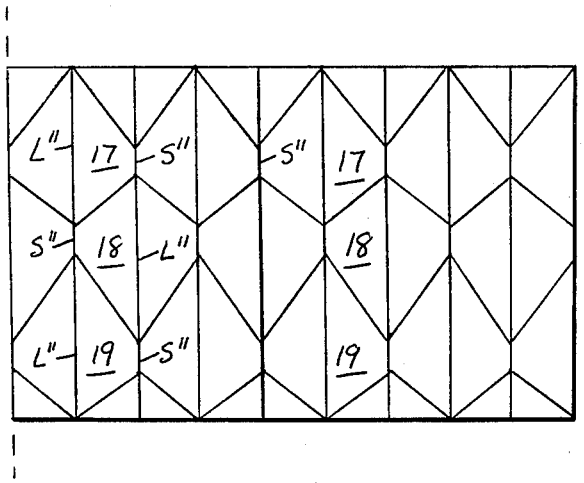
FIG. 6 is a plan view of a portion of a blank which is like that of FIG. 5 except that the trapezoids are unsymmetrical.
Figure 7:
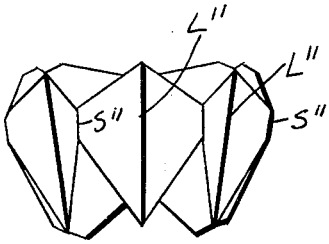
FIG. 7 is a side view showing one position of the assembled polyhedron made from the blank of FIG. 6.

Turning to FIGS. 5 to 7 (in which there are three rows 14, 15, 16 or 17, 18, 19 of large polygons, rather than the four rows in FIGS. 1 to 4) the resulting polyhedron forms eight stable positions. A configuration having five such rows would form 12 stable positions and so forth, each additional row of trapezoids resulting in additions of two more stable positions.

The number of polygons per row will generally be greater when the polygons are trapezoids than when they are triangles as in my parent patent. Thus in FIGS. 1 to 4 (having four rows of "large" polygons) there are 24 per row. If the length ratio of the long sides L to the parallel short sides S is made greater, the number of polygons per row may be conveniently reduced, e.g. to 20 per row. If the number of such rows is reduced the number of polygons per row may similarly be decreased; thus for figures with three rows of trapezoids there may be 14 (as in FIGS. 5 to 7) or more per row.

Various modifications may be used, as in my parent patent. Thus the edge triangles may be altered in shape as in FIGS. 1A, 1B, 1C, 1D and 1E of my parent patent, or omitted. The trapezoids (and edge triangles) may have apertures or windows. The blanks need not be rectangular but rather have, say, broken diagonal ends, which ends may then be joined together in any suitable manner as by means of attaching tabs. Different materials of construction, colors and textures may be employed, as described in my parent patent, and the products are suitable for the uses listed therein.

Figure 8:
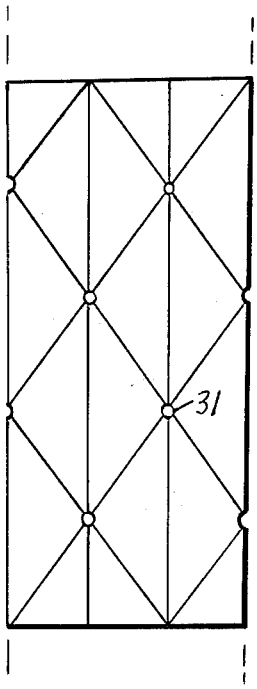
FIG. 8 shows a modification with holes at some triangle vertices.

Another aspect of this invention involves a modification of the triangle-containing structures described in my parent patent, as well as the structures shown in the Walker patent. This involves truncating all or part of the large triangles without otherwise changing the arrangements and relationships of the triangles, thus creating holes, or windows, in the finished structure; this truncation can eliminate all or part of the apices of the triangles, as in FIG. 8 having holes 31 (in this case of small size) instead of apices.

It is understood that the foregoing detailed description is given merely by way of illustration and that variations may be made therein wihout departing from the spirit of the invention.

I claim:

1. A polyhedral structure which is radially substantially symmetrical about a central axis, said structure comprising a number of planar trapezoids hinged together at their sides so as to form a continuous multiplanar toroidal web having two edges, which structure can be rotated, about its core, into a plurality of different stable configurations each of which is radially substantially symmetrical about said central axis, said structure comprising congruent plane trapezoids arranged in an least three rows of adjacent trapezoids, each of said rows being a ring of single trapezoids arranged in alternation so that each trapezoid has a hinged longer side in common with one of its two neighbors of its row and has a hinged shorter side in common with the other of its neighbors of its row, said rows interfitting so that each trapezoid of each row has a side in common with a trapezoid of the adjacent row, the longer and shorter common sides within a row being respectively, infold and outfold hinges arranged within planes which radiate from and include said axis and the sides which adjacent rows have in common being outfold hinges.

2. A structure as in claim 1 in which two of said rows are adjacent to said edges of said structure and the others of said rows are arranged between said edge-adjacent rows, the trapezoids of said edge-adjacent rows each have a side which is not common to another trapezoid of said rows, and said non-common sides of adjacent trapezoids of said rows are connected by a folded web having an infold hinge in one of said radial planes, with outfold hinges at said non-common sides.

3. A structure as in claim 1 in which there are four of said rows, said structure being rotatable to 10 different stable positions.

4. A structure as in claim 1 in which there are three of said rows, said structure being rotatable to eight different stable positions.

5. A structure as in claim 1 in which said congruent trapezoids are symmetrical.

6. A structure as in claim 1 in which said congruent trapezoids are asymmetrical.

7. A flat blank of sheet material, said blank having means, including score lines at which said blank can be folded and edges adapted to be secured together to form a continuous web after said blank is folded at said score lines, for converting said blank to a polyhedral structure which is radially substantially symmetrical about a central axis, said structure comprising a number of planar trapezoids hinged together at their sides so as to form a continuous multiplanar toroidal web having two edges, which structure can be rotated, about its core, into a plurality of different stable configurations each of which is radially substantially symmetrical about said central axis, said structure comprising congruent plane trapezoids arranged in at least three rows of adjacent trapezoids, each of said rows being a ring of single trapezoids arranged in alternation so that each trapezoid has a hinged longer side in common with one of its two neighbors of its row and has a hinged shorter side in common with the other of its nieghbors of its row, said rows interfitting so that each trapezoid of each row has a side in common with a trapezoid of the adjacent row, the longer and shorter common sides within a row being, respectively, infold and outfold hinges arranged within planes which radiate from and include said axis and the sides which adjacent rows have in common being outfold hinges, said score lines being situated so that, on folding, they form the boundaries of said trapezoids.

8. A blank as in claim 7 in which two of said rows are adjacent to said edges of said structure and the others of said rows are arranged between said edge-adjacent rows, the trapezoids of said edge-adjacent rows each have a side which is not common to another trapezoid of said rows, and said non-common sides of adjacent trapezoids of said rows are connected in said structure by a folded web having an infold hinge in one of said radial planes, with outfold hinges at said non-common sides.

9. A blank as in claim 7 in which there are four of said rows, said structure being rotatable to 10 different stable positions.

10. A blank as in claim 7 in which there are three of said rows, said structure being rotatable to eight different stable positions.

11. A blank as in claim 7 in which said congruent trapezoids are symmetrical.

12. A blank as in claim 7 in which said congruent trapezoids are asymmetrical.

* * * * *